US011118138B2

(12) United States Patent
Schaefer et al.

(10) Patent No.: US 11,118,138 B2
(45) **Date of Patent: *Sep. 14, 2021**

(54) NON-ENZYMATIC REMOVAL OF PROTEINACEOUS SOILS WITH A SALICYLIDENE-BASED CHELANT

(71) Applicant: Henkel AG & Co. KGaA, Duesseldorf (DE)

(72) Inventors: Sascha Schaefer, Mettmann (DE); Iris Dienwiebel, Lengerich (DE); Christian Umbreit, Neuss (DE); Christian Kropf, Hilden (DE); Tatjana Parac-Vogt, Leuven (BE); Thomas Quanten, Leuven (BE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/735,335

(22) Filed: Jan. 6, 2020

(65) Prior Publication Data

US 2020/0216779 A1 Jul. 9, 2020

(30) Foreign Application Priority Data

Jan. 4, 2019 (EP) ..... 19150311

(51) Int. Cl.

| | |
|---|---|
| ***C11D 3/30*** | (2006.01) |
| ***C11D 3/00*** | (2006.01) |
| ***A47L 15/00*** | (2006.01) |
| ***C11D 3/43*** | (2006.01) |
| ***C11D 11/00*** | (2006.01) |

(52) U.S. Cl.

CPC ..... *C11D 3/001* (2013.01); *A47L 15/0057* (2013.01); *C11D 3/30* (2013.01); *C11D 3/43* (2013.01); *C11D 11/0023* (2013.01)

(58) Field of Classification Search

CPC ..... C11D 3/30; C11D 3/33; C11D 11/0023; C11D 17/049

See application file for complete search history.

(56) References Cited

U.S. PATENT DOCUMENTS

2016/0308220 A1* 10/2016 Qi ..... H01M 4/8871

FOREIGN PATENT DOCUMENTS

| | | | |
|---|---|---|---|
| EP | 0286075 | A2 | 10/1988 |
| KR | 100470889 | B1 | 1/2005 |
| WO | 9623860 | A1 | 8/1996 |
| WO | 9744427 | A1 | 11/1997 |
| WO | 2005059076 | A1 | 6/2005 |

OTHER PUBLICATIONS

Baucherel, Xavier et al. "Unexpected Catalyzed C=C Bond Cleavage by Molecular Oxygen Promoted by a Thiyl Radical". Journal Organic Chemistry, vol. 66 No. 13. May 26, 2001, pp. 4504-4510. Extended European Search Report EP 19150311.9 Completed: Jun. 5, 2019 dated Jun. 24, 2019 5 pages.

* cited by examiner

*Primary Examiner* — Charles I Boyer
(74) *Attorney, Agent, or Firm* — Bojuan Deng

(57) ABSTRACT

The object of the present invention is to provide a composition suitable for cleaning cooked-, baked- and burnt-on soils, which has improved efficacy on proteinaceous soils. Detergent compositions having metal complexes with certain salicylidene ligands solve this problem.

15 Claims, No Drawings

NON-ENZYMATIC REMOVAL OF PROTEINACEOUS SOILS WITH A SALICYLIDENE-BASED CHELANT

FIELD OF THE INVENTION

The present invention relates to detergents, especially hard surface cleaning compositions, and among those especially dishwashing compositions, comprising metal complexes with certain salicylidene ligands. In addition, it relates to the use of such complexes to remove baked-on soils from surfaces, especially hard surfaces, for example the surfaces of cookware, tableware, and kitchen surfaces.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Manual dishwashing process requires a tremendous rubbing effort to remove cooked-, baked- and burnt-on soils and this can be detrimental to the safety and condition of the cookware/tableware. Generally, all cooked-, baked- and burnt-on soils are difficult to remove, however of particular relevance herein are the protein-based soils.

The use of cleaning compositions for removing cooked-, baked- and burnt-on solids is known in the art. For example, European patent application EP 0 286 075 A2 provides a method for treating hard surfaces soiled with cooked-on, baked-on or dried-on food residues, comprising applying to the soiled article a pre-spotting composition that comprises 1-40% of surfactant, 1-10% of builder, 0.2-2% of mono-, di- and/or triethanolamine, water, and 3-50% of organic solvents. International patent application WO 97/44427 A1 provides an aqueous hard surface cleaning composition for removing hardened dried or baked-on grease soil deposits; the composition comprises 0.01-0.85% amine oxide non-ionic surfactant, up to 1.5% chelating agent, 0.01-2.5% caustic, 3-9% of a glycol ether solvent system, up to 5% water soluble organic amine and up to 2.5% of an anti-redeposition agent. From the international patent application WO 2005/059076 A1 compositions for removing burnt-on soils are known; they comprise alkyl esters as surface modifying agents, soil swelling agents such as monoethanolamine, and an enzyme.

While those compositions do have some efficacy in the removal of grease-based soils, they are not effective in the removal of burnt-on protein-based soils. Agents of choice to break up proteins in stains are proteases; however, the thermal treatment during cooking-on or baking-on changes the structure of proteins, partially degrades proteins and forms different bonds among the protein parts and possibly other components of the soil. Many proteases show low performance on aged proteins and proteins which suffered such reactions.

BRIEF SUMMARY OF THE INVENTION

It is therefore an object of the present invention to provide a composition suitable for cleaning cooked-, baked- and burnt-on soils, which has improved efficacy on proteinaceous soils.

According to the present invention there is provided a detergent composition suitable for removing cooked-, baked- and burnt-on proteinaceous soils from surfaces, comprising a complex of a metal of groups 2 to 15 of the periodic system of elements with a ligand of formula I,

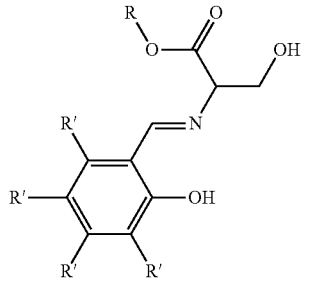

in which R stands for a linear or branched alkyl group, or a cycloalkyl, alkenyl, alkinyl, aryl or heteroaryl group with 1 to 20 C atoms, and each R', irrespective of each other, stands for —H, a linear or branched alkyl group, or —F, —Cl, —Br, —I, —$CF_3$, —OR", —$NO_2$, —$NH_2$, aryl, —CHO, —$Si(CH_3)_3$, —$SO_3^-M^+$, with M=Na, H or K, —$CO_2$R" or —C(=O)R" with R"=H or alkyl, preferred $CH_3$ or $C_2H_5$. Each hydrocarbon moiety can have one or more heteroatoms, preferred are O, N, S, Si, P. Preferred metals in the complexes with the ligand of formula (I) are selected from Ca, Mg, Ti, Zr, Ce, Fe, Mn, Zn, Cu, Co, V, and mixtures thereof. Most preferred are Zn, Zr, Ti, Ce. The preferred in oxidation states of the central metal atom are 1, 2, 3 or 4. Preferred are ligands according to formula (I), in which R stands for an alkyl group with 1 to 10 C atoms, in which all substituents R' are equal, and/or in which at least one R' stands for H or —F, —Cl, —Br, —I, —$CF_3$, —OH, —$OCH_3$, —$OC_2H_5$, —$NO_2$, —$NH_2$, —$CO_2H$, —$CO_2CH_3$, —$CO_2C_2H_5$, —C(=O)$CH_3$, —CHO, —$Si(CH_3)_3$, —$SO_3^-M^+$, with M is Na, H or K. The ligand of formula I may be present in the complexes one, two or more times per central metal atom.

The compositions of the present invention are suitable to be used in conventional washing and cleaning operations, such as manual or automatic laundry processes, and, preferably, the manual or automatic cleaning of hard surfaces, such as floors, tiles, kitchen surfaces, and, especially, surfaces that came into contact with protein containing food while being hot. Among the latter are for example cooking pots and pans, baking tins and moulds, stove plates and the interior surfaces of baking ovens. The detergents of the invention may be in the form of solids, liquids, gels or pastes and may exist as, for example, powders, tablets, bars, homogeneous liquids, microemulsions or emulsions. They preferably comprise said complex with a ligand of formula I in amounts of from 0.001% by weight to 20% by weight, more preferably from 0.01% by weight to 1% by weight; percentages given by weight here and in each following case are based on the total weight of the detergent, unless otherwise defined. The detergent compositions of the invention can be used as manual or automatic dishwashing detergent compositions or as a component thereof. If cooked-, baked- or burnt-on proteinaceous soil is to be removed from textiles, the detergent compositions of the invention can also be used as manual or automatic laundry detergent compositions or as a component thereof.

Complexes useful for this invention may be prepared by a metal salt with several (preferred two) equivalents of the ligand in a suitable solvent, preferably an alcohol, stirred at room temperatures for several hours (preferred one hour) and subsequent removal of the solvent to obtain the desired compound, as for example described in J. Org. Chem. 2001, 66, 4504-4510. Alternatively, the complexes can be prepared in situ prior the intended use by dissolving a suitable amount of metal salt in the presence of several (preferred two) equivalents of ligand in water or an alcohol and used without purification.

The amount of complex or of the detergent composition comprising it necessary to provide the required functionality will depend upon the nature of the complex or composition and can be determined by routine experimentation. Other conditions effective for removing cooked-, baked- and burnt-on proteinaceous soils, such as pH, temperature and treatment time, can also be determined by routine experimentation. Preferred herein, however is to employ aqueous washing or cleaning liquids that comprise a complex with a ligand of formula I in concentrations of from 0.001 mmol/l to 10 mmol/l, more preferred from 0.01 mmol/l to 5 mmol/l, and especially from 0.1 mmol/l to 1 mmol/l. A contact of the aqueous liquid with the proteinaceous soil for time periods in the range of from 2 minutes to 24 hours, preferably from 10 minutes to 12 hours, more preferably from 30 minutes to 4 hours are normally quite sufficient to remove the soils. Especially for manual processes the aqueous washing or cleaning liquid may be of ambient temperature or may be heated to higher temperatures still comfortable for manual contact; automatic processes may be operated at temperatures common for the device employed, such as for example 60° C., 40° C., 30° C., or 20° C. for laundry machines and for example 60° C., 55° C., 50° C., 45° C. or 40° C. for dishwashing machines.

Another subject of the invention is the use of said complex or of a detergent comprising said complex to remove cooked-, baked- and burnt-on proteinaceous soils from surfaces, preferably hard surfaces, or textile surfaces. The features given above are characteristics of preferred variants of such a use. Also, the features of the detergents given below are characteristics of preferred variants of such a use.

Still another subject of the invention is a method of removing cooked-, baked- and burnt-on proteinaceous soils from surfaces, preferably hard surfaces, or textile surfaces, by contacting the soiled surface with an aqueous liquid comprising said complex. The features given above are characteristics of preferred variants of such a process. Also, the features of the detergents given below are characteristics of preferred variants of such a process.

DETAILED DESCRIPTION OF THE INVENTION

The present invention provides a detergent composition suitable for removing cooked-, baked- and burnt-on proteinaceous soils from surfaces, comprising a complex of a metal of groups 2 to 15 of the periodic system of elements with a ligand of formula I,

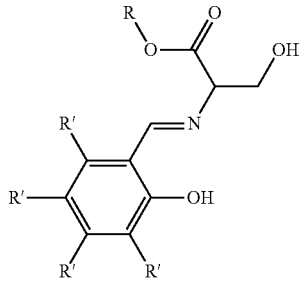

in which R stands for a linear or branched alkyl group, or a cycloalkyl, alkenyl, alkinyl, aryl or heteroaryl group with 1 to 20 C atoms, and each R', irrespective of each other, stands for —H, a linear or branched alkyl group, or —F, —Cl, —Br, —I, —$CF_3$, —OR", —$NO_2$, —$NH_2$, aryl, —CHO, —$Si(CH_3)_3$, —$SO_3^-M^+$, with M=Na, H or K, —$CO_2$R" or —C(=O)R" with R"=H or alkyl, preferred $CH_3$ or $C_2H_5$. Each hydrocarbon moiety can have one or more heteroatoms, preferred are O, N, S, Si, P. Preferred metals in the complexes with the ligand of formula (I) are selected from Ca, Mg, Ti, Zr, Ce, Fe, Mn, Zn, Cu, Co, V, and mixtures thereof. Most preferred are Zn, Zr, Ti, Ce. The preferred in oxidation states of the central metal atom are 1, 2, 3 or 4. Preferred are ligands according to formula (I), in which R stands for an alkyl group with 1 to 10 C atoms, in which all substituents R' are equal, and/or in which at least one R' stands for H or —F, —Cl, —Br, —I, —$CF_3$, —OH, —$OCH_3$, —$OC_2H_5$, —$NO_2$, —$NH_2$, —$CO_2H$, —$CO_2CH_3$, —$CO_2C_2H_5$, —C(=O)$CH_3$, —CHO, —$Si(CH_3)_3$, —$SO_3^-M^+$, with M is Na, H or K. The ligand of formula I may be present in the complexes one, two or more times per central metal atom.

The composition of the present invention preferably comprises said complex with a ligand of formula I in amounts of from 0.001% by weight to 20% by weight, more preferably from 0.01% by weight to 1% by weight; percentages given by weight here and in each following case are based on the total weight of the detergent, unless otherwise defined.

In some embodiments, the composition of the present invention comprises a complex with a ligand of formula I in concentrations of from 0.001 mmol/l to 10 mmol/l, more preferred from 0.01 mmol/l to 5 mmol/l, and especially from 0.1 mmol/l to 1 mmol/l. A contact of the aqueous liquid with the proteinaceous soil for time periods in the range of from 2 minutes to 24 hours, preferably from 10 minutes to 12 hours, more preferably from 30 minutes to 4 hours are normally quite sufficient to remove the soils. Especially for manual processes the aqueous washing or cleaning liquid may be of ambient temperature or may be heated to higher temperatures still comfortable for manual contact; automatic processes may be operated at temperatures common for the device employed, such as for example 60° C., 40° C., 30° C., or 20° C. for laundry machines and for example 60° C., 55° C., 50° C., 45° C. or 40° C. for dishwashing machines.

The detergent compositions comprising said complex are particularly effective in removing proteinaceous soils from metallic or glass surfaces. They are also particularly effective in removing proteinaceous soils which are or comprise a product of a thermal reaction of a protein with a carbohydrate, the so-called Maillard reaction. The expression "a protein" or "a carbohydrate" encompasses a single protein and a single carbohydrate as well as mixtures of proteins and mixtures of carbohydrates.

The detergents according to the invention may comprise further components that do not unfavourably interact with said complex, preferably selected from the group consisting of surfactants, in particular non-ionic surfactants and/or anionic surfactants, builders, enzymes, sequestering agents, electrolytes, corrosion inhibitors, suds suppressors, dyes, and fragrances. More preferably the detergents at least comprise a surfactant in addition to said complex. They may also comprise peroxygen-based-bleaching agents, although those are not necessarily required for the catalytic action of the complex. Without wishing to be bound by theory, it is believed that in the absence of peroxygen-based bleaching agents oxygen out of the surrounding air will be sufficiently effective in sustaining the catalytic action of the complex.

The detergents described herein preferably comprise at least one non-ionic surfactant. All non-ionic surfactants known to a person skilled in the art may be used. Suitable non-ionic surfactants are, for example, alkyl glycosides of the general formula $RO(G)_x$, in which R corresponds to a primary straight-chain or methyl-branched, in particular methyl-branched at the 2-position, aliphatic functional group having 8 to 22, and preferably 12 to 18 carbon atoms, and G is the symbol that denotes a glycose unit having 5 or 6 carbon atoms, and preferably glucose. The degree of oligomerization x, which indicates the distribution of monoglycosides and oligoglycosides, is an arbitrary number between 1 and 10; x is preferably 1.2 to 1.4.

Non-ionic surfactants of the amine oxide type, for example N-cocoalkyl-N—N-dimethylamine oxide and N-tallowalkyl-N,N-dihydroxyethylamine oxide, and of the fatty acid alkanolamide type may also be suitable. The quantity of these non-ionic surfactants is preferably no more than that of the ethoxylated fatty alcohols, in particular no more than half thereof.

Further suitable surfactants are polyhydroxy fatty acid amides.

Preferably, however, low-sudsing non-ionic surfactants are used, in particular alkoxylated, and especially ethoxylated, low-sudsing non-ionic surfactants. It is particularly preferred when the automatic dishwasher detergents comprise non-ionic surfactants from the group of alkoxylated alcohols.

One class of non-ionic surfactants that can be used, which can be used either as the sole non-ionic surfactant or in combination with other non-ionic surfactants, is thus alkoxylated, preferably ethoxylated or ethoxylated and propoxylated fatty acid alkyl esters, preferably comprising 1 to 4 carbon atoms in the alkyl chain.

Surfactants that should preferably be used come from the groups of the ethoxylated primary alcohols and mixtures of these surfactants with structurally more complicated surfactants, such as polyoxypropylene/polyoxyethylene/polyoxypropylene (PO/EO/PO) surfactants. Such (PO/EO/PO) non-ionic surfactants are characterized by good suds control.

Non-ionic surfactants comprising alternating ethylene oxide and alkylene oxide units may be preferred. Among these, in turn, surfactants comprising EO-AO-EO-AO blocks are preferred, wherein in each case one to ten EO or AO groups are bound to one another before a block from the respective other group follows. Here, non-ionic surfactants of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

are preferred, in which $R^1$ denotes a straight-chain or branched, saturated, monounsaturated or polyunsaturated $C_{6-24}$ alkyl functional group or alkenyl residue, each group $R^2$ and $R^3$, independently of one another, is selected from —$CH_3$, —$CH_2CH_3$, —$CH_2CH_2$—$CH_3$, $C(CH_3)_2$, and the subscripts w, x, y and z, independently of one another, denote integers from 1 to 6.

Thus, in particular, non-ionic surfactants are preferred that comprise a $C_{9-15}$ alkyl functional group having 1 to 4 ethylene oxide units, followed by 1 to 4 propylene oxide units, followed by 1 to 4 ethylene oxide units, followed by 1 to 4 propylene oxide units.

Preferred non-ionic surfactants are therefore those of the general formula $$R^1—CH(OH)CH_2O-(AO)_w-(A'O)_x-(A''O)_y-(A'''O)_z—R^2,$$

in which $R^1$ denotes a straight-chain or branched, saturated, monounsaturated or polyunsaturated $C_{6-24}$ alkyl functional group or alkenyl residue; $R^2$ denotes H or a linear or branched hydrocarbon functional group having 2 to 26 carbon atoms; A, A', A'' and A''', independently of one another, denote a functional group from the group consisting of —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, $CH_2$—$CH(CH_2$—$CH_3)$; and w, x, y and z denote values between 0.5 and 120, wherein x, y and/or z may also be 0.

Preferred are in particular end-capped poly(oxyalkylated) non-ionic surfactants that, according to formula $R^1O[CH_2CH_2O])_xCH_2CH(OH)R^2$, in addition to a functional group $R^1$, which denotes linear or branched, saturated or unsaturated, aliphatic or aromatic hydrocarbon functional groups having 2 to 30 carbon atoms, and preferably having 4 to 22 carbon atoms, also comprise a linear or branched, saturated or unsaturated aliphatic or aromatic hydrocarbon functional group $R^2$ having 1 to 30 carbon atoms, wherein x denotes values between 1 and 90, preferably values between 30 and 80, and in particular values between 30 and 60.

Particularly preferred are surfactants of formula $R^1O[CH_2CH(CH_3)O]_x[CH_2CH_2O]_yCH_2CH(OH)R^2$, in which $R^1$ denotes a linear or branched, aliphatic hydrocarbon functional group having 4 to 18 carbon atoms or mixtures thereof, $R^2$ denotes a linear or branched hydrocarbon functional group having 2 to 26 carbon atoms or mixtures thereof, x denotes values between 0.5 and 1.5, and y denotes a value of at least 15.

The group of these non-ionic surfactants includes, for example, the $C_{2-26}$ fatty alcohol-$(PO)_t$-$(EO)_{15-40}$-2-hydroxyalkyl ethers, and in particular also the $C_{8-10}$ fatty alcohol-$(PO)_t$-$(EO)_{22}$-2-hydroxydecyl ethers. Particularly preferred are furthermore those end-capped poly(oxyalkylated) non-ionic surfactants of formula $R^1O[CH_2CH_2O]x[CH_2CH(R^3)O]_yCH_2CH(OH)R^2$, in which $R^1$ and $R^2$, independently of one another, denote a linear or branched, saturated, monounsaturated or polyunsaturated hydrocarbon functional group having 2 to 26 carbon atoms, $R^3$, independently of one another, is selected from —$CH_3$, —$CH_2CH_3$, —$CH_2CH_2$—$CH_3$, —$CH(CH_3)_2$, preferably however is —$CH_3$, and x and y, independently of one another, denote values between 1 and 32, wherein non-ionic surfactants where $R^3$=—$CH_3$ and values for x are from 15 to 32 and for y from 0.5 to 1.5 are especially particularly preferred.

Further non-ionic surfactants that may preferably be used are the end-capped poly(oxyalkylated) non-ionic surfactants of formula $R^1O[CH_2CH(R^3)O]_x[CH_2]_kCH(OH)[CH_2]_jOR^2$, in which $R^1$ and $R^2$ denote linear or branched, saturated or unsaturated, aliphatic or aromatic hydrocarbon functional groups having 1 to 30 carbon atoms, $R^3$ denotes H or a methyl, ethyl, n-propyl, iso-propyl, n-butyl, 2-butyl or 2-methyl-2-butyl functional group, x denotes values between 1 and 30, and k and j denote values between 1 and 12, and preferably between 1 and 5. When the value x≤2, each $R^3$ in the above formula $R^1O[CH_2CH(R^3)O]_x[CH_2]_kCH(OH)[CH_2]OR^2$ may be different. $R^1$ and $R^2$ are preferably linear or branched, saturated or unsaturated, aliphatic or aromatic hydrocarbon functional groups having 6 to 22 carbon atoms; wherein functional groups having 8 to 18 carbon atoms are particularly preferred. H, $CH_3$ or $—CH_2CH_3$ are particularly preferred for the functional group $R^3$. Particularly preferred values for x are in the range of 1 to 20, and in particular of 6 to 15.

As described above, each $R^3$ in the above formula may be different when x 2. In this way, the alkylene oxide unit in the square brackets may be varied. For example, when x is 3, then the functional group $R^3$ may be selected so as to form ethylene oxide-($R^3$═H) or propylene oxide-($R^3$═$CH_3$) units, which may be joined to one another in any arbitrary order, for example (EO)(PO)(EO), (EO)(EO)(PO), (EO)(EO)(EO), (PO)(EO)(PO), (PO)(PO)(EO) and (PO)(PO)(PO). The value 3 for x has been selected by way of example here and may certainly also be larger, wherein the variation range increases with increasing x values and, for example, includes a large number of (EO) groups, combined with a low number of (PO) groups, or vice versa.

Particularly preferred end-capped poly(oxyalkylated) alcohols of the above formula have values of k=1 and j=1; whereby the above formula is simplified to $R^1O[CH_2CH(R^3)O]_x[CH_2CH(OH)[CH_2OR^2$. In the last formula, $R^1$, $R^2$ and $R^3$ are as defined above, and x denotes numbers from 1 to 30, preferably from 1 to 20, and in particular 6 to 18. Particularly preferred are surfactants in which the functional groups $R^1$ and $R^2$ comprise 9 to 14 carbon atoms, $R^3$ denotes H, and x takes on values from 6 to 15.

Non-ionic surfactants that have proven to be particularly effective are those of the general formula $R^1$—CH(OH)$CH_2O$-$(AO)_w$—$R^2$ in which $R^1$ denotes a straight-chain or branched, saturated, monounsaturated or polyunsaturated $C_{6-24}$ alkyl functional group or alkenyl residue; $R^2$ denotes a linear or branched hydrocarbon functional group having 2 to 26 carbon atoms; A denotes a functional group from the group consisting of $CH_2CH_2$, $CH_2CH_2CH_2$, $CH_2CH(CH_3)$, and preferably $CH_2CH_2$, and w denotes values between 1 and 120, preferably 10 to 80, and in particular 20 to 40. The group of these non-ionic surfactants includes, for example, the $C_{4-22}$ fatty alcohol-$(EO)_{10-80}$-2-hydroxyalkyl ethers, and in particular also the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

In various embodiments of the invention, it is also possible to use the corresponding not end-capped hydroxy mixed ethers instead of the above-defined end-capped hydroxy mixed ethers. These can satisfy the above formulas, wherein, however, $R^2$ is hydrogen, and R', $R^3$, A, A', A", A'", w, x, y and z are as defined above.

Different embodiments of the detergents comprise the surfactant in an amount of at least 2 wt. %, and preferably of at least 5 wt. %. The absolute amounts used per application may be in the range of 0.5 to 10 g/job, and preferably in the range of 1 to 5 g/job, for example.

All anionic surface-active substances are suitable in the detergents. These are characterized by a water-soluble-rendering anionic group, such as a carboxylate, sulfate, sulfonate or phosphate group and a lipophilic alkyl group having approximately 8 to 30 carbon atoms. In addition, glycol or polyglycol ether groups, ester, ether and amide groups and hydroxyl groups can be present in the molecule. Suitable anionic surfactants are preferably present in the form of the sodium, potassium and ammonium salts, and monoalkanol, dialkanol and trialkanol ammonium salts having 2 to 4 carbon atoms in the alkanol group.

Preferred anionic surfactants are alkyl sulfates, alkyl polyglycol ether sulfates and ether carboxylic acids having 10 to 18 carbon atoms in the alkyl group, and up to 12 glycol ether groups in the molecule.

In various embodiments, the detergents thus comprise at least one surfactant of formula $R^4$—O-$(AO)_n$—$SO_3^-X^+$.

In this formula, $R^4$ denotes a linear or branched, substituted or unsubstituted alkyl, aryl or alkyl-aryl functional group, preferably a linear, unsubstituted alkyl functional group, and particularly preferably a fatty alcohol functional group. Preferred functional groups $R^1$ are selected from decyl, undecyl, dodecyl, tridecyl, tetradecyl, pentadecyl, hexadecyl, heptadecyl, octadecyl, nonadecyl and eicosyl functional groups and the mixtures thereof, wherein representatives having an even number of carbon atoms are preferred. Particularly preferred functional groups $R^1$ are derived from $C_{12}$ to $C_{18}$ fatty alcohols, for example from coconut fatty alcohol, tallow fatty alcohol, lauryl, myristyl, cetyl or stearyl alcohol, or from $C_{10}$ to $C_{20}$ oxo alcohols. AO denotes an ethylene oxide (EO) or propylene oxide (PO) grouping, preferably an ethylene oxide grouping. The subscript n denotes an integer from 1 to 50, preferably from 1 to 20, and in particular from 2 to 10. It is especially particularly preferred if n denotes the numbers 2, 3, 4, 5, 6, 7, or 8. X denotes a monovalent cation or the nth part of an n-valent cation, alkali metal ions being preferred, and among these $Na^+$ or $K^+$, $Na^+$ being extremely preferred. Further cations $X^+$ may be selected from $NH_4$+, ½ $ZN^{2+}$, ½ $Ca^{2+}$, ½ $Mn^{2+}$ and mixtures thereof.

Particularly preferred anionic surfactants are selected from ether sulfates of formula A-1

(A-1)

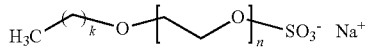

where k=11 to 19, n=2, 3, 4, 5, 6, 7 or 8. Especially particularly preferred representatives are Na—$C_{12-14}$ fatty alcohol ether sulfates comprising 2 EO (k=11 to 13, n=2 in formula A-1).

In addition or as an alternative, the detergents can furthermore comprise at least one surfactant of formula $R^5$-A-$SO_3^-Y^+$. In this formula, $R^5$ denotes a linear or branched, substituted or unsubstituted alkyl, aryl or alkyl-aryl functional group, and the grouping -A-denotes —O— or a chemical bond. In other words, the above-described formula can be used to describe sulfate- (A=0) or sulfonate- (A=chemical bond) surfactants. Depending on the selection of the grouping A, certain functional groups $R^5$ are preferred. In the sulfate surfactants (A=O), $R^5$ is preferably a linear, unsubstituted alkyl functional group, and particularly preferably a fatty alcohol functional group. Preferred functional groups $R^5$ are selected from decyl, undecyl, dodecyl, tridecyl, tetradecyl, pentadecyl, hexadecyl, heptadecyl, octadecyl, nonadecyl and eicosyl functional groups and the mixtures thereof, wherein representatives having an even number of carbon atoms are preferred. Particularly preferred functional groups $R^5$ are derived from $C_{12}$ to $C_{-18}$ fatty alcohols, for example from coconut fatty alcohol, tallow fatty alcohol, lauryl, myristyl, cetyl or stearyl alcohol, or from $C_{10}$ to $C_{20}$ oxo alcohols. Y denotes a monovalent cation or the nth part of an n-valent cation, alkali metal ions being preferred, and among these $Na^+$ or $K^+$, $Na^+$ being extremely preferred. Further cations Y+ can be selected from $NH_4^+$, ½ $Zn^{2+}$, ½ $Mg^{2+}$, ½ $Ca^{2+}$, ½ $Mn^{2+}$, and the mixtures thereof.

Such particularly preferred surfactants are selected from fatty alcohol sulfates of formula

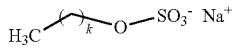

where k=11 to 19. Especially particularly preferred representatives are Na—$C_{12-14}$ fatty alcohol sulfates (k=11 to 13).

In the sulfonate surfactants (A=chemical bond), $R^5$ is preferably a linear or branched unsubstituted alkyl-aryl functional group. Again, X denotes a monovalent cation or the nth part of an n-valent cation, alkali metal ions being preferred, and among these $Na^+$ or $K^+$, $Na^+$ being extremely preferred. Further cations X+ can be selected from $NH_4^+$, ½ $Zn^{2+}$, ½ $Mg^{2+}$, ½ $Ca^{2+}$, ½ $Mn^{2+}$, and the mixtures thereof. Such surfactants may be selected from linear or branched alkylbenzene sulfonates.

Cationic and/or amphoteric surfactants, such as betaines or quaternary ammonium compounds, can also be used instead of or in conjunction with the described surfactants. However, it is preferred that no cationic and/or amphoteric surfactants are used.

Builders that may be present in the detergent are in particular silicates, aluminum silicates (in particular zeolites), carbonates, organic dicarboxylic and polycarboxylic acids, and amino carboxylic acids and the salts thereof, and, where ecological bias against their use is absent, also phosphates. Naturally, mixtures of these substances may also be used.

For example, it is possible to use crystalline phyllosilicates of the general formula $NaMSi_xO_{2x+1}.y\ H_2O$, in which M is sodium or hydrogen, x is a number from 1.9 to 22, and preferably from 1.9 to 4, wherein particularly preferred values for x are 2, 3 or 4, and y is a number from 0 to 33, and preferably from 0 to 20. The crystalline phyllosilicates of formula $NaMSi_xO_{2x+1}.y\ H_2O$ are sold under the trade name Na-SKS by Clariant GmbH (Germany), for example. Examples of these silicates are Na-SKS-1 ($Na_2Si_{22}O_{45}.x\ H_2O$, kenyaite), Na-SKS-2 ($Na_2S_{14}O_{29}.x\ H_2O$, magadiite), Na-SKS-3 ($Na_2S_{15}O_{17}.x\ H_2O$) or Na-SKS-4 ($Na_2S_{14}O_9.x\ H_2O$, makatite). For the purposes of the present invention, crystalline phyllosilicates of formula $NaMSi_xO_{2x+1}.y\ H_2O$ in which x denotes 2 are particularly suitable. In particular, both β- and δ-sodium silicates $Na_2Si_2O_5.y\ H_2O$ are preferred, and furthermore especially Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3\ H_2O$, kanemite), Na-SKS-11 (t-$Na_2Si_2O_5$) and Na-SKS-13 ($NaHSi_2O_5$), in particular however Na-SKS-6 ($\delta$-$Na_2Si_2O_5$).

It is also possible to use amorphous sodium silicates having a $Na_2O:SiO_2$ module of 1:2 to 1:3.3, preferably of 1:2 to 1:2.8, and in particular of 1:2 to 1:2.6, which preferably exhibit retarded dissolution and secondary washing properties. The retarded dissolution compared to conventional amorphous sodium silicates can have been caused in a variety of ways, for example by way of surface treatment, compounding, compacting/compression or over-drying. Within the scope of the present invention, the term "amorphous" shall be understood to mean that the silicates do not supply any sharp X-ray reflexes in X-ray diffraction experiments, such as those that are typical of crystalline substances, but at best evoke one or more maxima of the scattered X-rays, which have a width of several degree units of the diffraction angle. Within the scope of the present invention, it is preferred that this silicate or these silicates, preferably alkali silicates, and particularly preferably crystalline or amorphous alkali disilicates, is or are present in the detergents in amounts of 1 to 40 wt. %, and preferably of 2 to 35 wt. %.

It is also possible, of course, to use the generally known phosphates as builder substances, provided that such use should not be avoided for ecological reasons. Alkali metal phosphates is the term that covers all the alkali metal (in particular sodium and potassium) salts of the different phosphoric acids, in which a distinction can be made between metaphosphoric acids $(HPO_3)_n$ and orthophosphoric acid $H_3PO_4$, in addition to higher molecular weight representatives. The phosphates combine several advantages: They act as alkali carriers, prevent limescale deposits on machine parts or lime scaling on woven fabrics, and additionally contribute to the cleaning performance. Technically particularly important phosphates are pentasodium triphosphate, $Na_5P_3O_{10}$ (sodium tripolyphosphate), and the corresponding potassium salt pentapotassium triphosphate, $K_5P_3O_{10}$ (potassium tripolyphosphate) and corresponding mixed salts (sodium potassium tripolyphosphates). Preferably, however, the detergents are phosphate-free. If phosphate is used as substances with cleaning action in the detergent, preferred ones comprise phosphate in amounts from 5 to 80 wt. %, preferably from 10 to 60 wt. %, and in particular from 18 to 45 wt. %.

The detergents can in particular also comprise phosphonates as a further builder. The phosphonate compound used is preferably a hydroxyalkane phosphonate and/or aminoalkane phosphonate. Among the hydroxyalkane phosphonates, 1-hydroxyethane-1,1-diphosphonate (HEDP) is of particular importance. Possible preferred aminoalkane phosphonates include ethylenediaminetetramethylene phosphonate (EDTMP), diethylentriaminepentamethyl ene phosphonate (DTPMP) and the higher homologs thereof. Phosphonates are preferably present in the detergents in amounts of 0.1 to 10 wt. %, and in particular in amounts of 0.5 to 8 wt. %.

Other builders are also alkali carriers. For example, alkali metal hydroxides, alkali metal carbonates, alkali metal hydrogen carbonates, alkali metal sesquicarbonates, the described alkali silicates, alkali metasilicates and mixtures of the above-mentioned substances are considered alkali carriers, wherein within the meaning of the present invention preferably the alkali carbonates, in particular sodium carbonate, sodium hydrogen carbonate or sodium sesquicarbonate, can be used. A builder system containing a mixture of tripolyphosphate and sodium carbonate is particularly preferred. A builder system containing a mixture of tripolyphosphate and sodium carbonate and sodium silicate is likewise particularly preferred. Given the low chemical compatibility with the remaining ingredients of detergents compared to other builder substances, the optional alkali metal hydroxides are preferably used only in low amounts, preferably in amounts of less than 10 wt. %, especially less than 6 wt. %, particularly preferably less than 4 wt. %, and in particular less than 2 wt. %, Detergents that, based on the total weight thereof, comprise less than 0.5 wt. %, and in particular no alkali metal hydroxides, are particularly preferred.

The use of carbonate(s) and/or hydrogen carbonate(s), preferably alkali carbonate(s), particularly preferably sodium carbonate, in amounts from 2 to 50 wt. %, preferably from 5 to 40 wt. %, and in particular from 7.5 to 30 wt. %, is particularly preferred. Detergents that contain less than 20 wt. %, especially less than 17 wt. %, preferably less than 13 wt. %, and in particular less than 9 wt. % carbonate(s) and/or hydrogen carbonate(s), preferably alkali carbonate(s), particularly preferably sodium carbonate, are particularly preferred.

Usable organic builder substances are, for example, the polycarboxylic acids that can be used in the form of the free acid and/or of the sodium salts thereof, wherein polycarboxylic acids shall be understood to mean those carboxylic acids that carry more than one acid function. These include, for example, citric acid, adipic acid, succinic acid, glutaric acid, malic acid, tartaric acid, maleic acid, fumaric acid, saccharic acids, nitrilotriacetic acid (NTA), provided that such use is not objectionable for ecological reasons, and mixtures thereof. In addition to the builder effect, the free acids typically also have the property of being an acidifying component and are thus also used to set a lower and milder pH value of the detergents. In particular, citric acid, succinic acid, glutaric acid, adipic acid, gluconic acid and arbitrary mixtures of these shall be mentioned here.

The use of citric acid and/or citrates in detergents has proven to be particularly advantageous for the cleaning and rinsing performance. Amino carboxylic acids and/or the salts thereof are another significant class of phosphate-free builders. Particularly preferred representatives of this class are methyl glycine diacetic acid (MGDA) or the salts thereof, and glutamine diacetic acid (GLDA) or the salts thereof or ethylenediamine diacetic acid (EDDS) or the salts thereof. The content of these amino carboxylic acids or of the salts thereof can amount to between 0.1 and 30 wt. %, preferably between 1 and 25 wt. %, and in particular between 5 and 20 wt. %, for example. Amino carboxylic acids and the salts thereof can be used together with the above-mentioned builders, in particular also with the phosphate-free builders.

The detergents according to the invention can furthermore comprise a sulfo polymer. The percent by weight of the sulfo polymer in the detergent is preferably 0.1 to 20 wt %, in particular 0.5 to 18 wt. %, particularly preferably 1.0 to 15 wt. %, in particular 4 to 14 wt. %, and especially 6 to 12 wt. %. The sulfo polymer is typically used in the form of an aqueous solution, wherein the aqueous solutions typically comprise 20 to 70 wt %, in particular 30 to 50 wt. %, and preferably approximately 35 to 40 wt. % sulfo polymers. Preferably, the sulfo polymer used is a copolymeric polysulfonate, and preferably a hydrophobically modified copolymeric polysulfonate. The copolymers can comprise two, three, four or more different monomer units. Preferred copolymeric polysulfonates comprise at least one monomer from the group of the unsaturated carboxylic acids, in addition to sulfonic group-containing monomer(s). Particularly preferably, unsaturated carboxylic acids of formula $R^1(R^2)C{=}C(R^3)COOH$ are used as unsaturated carboxylic acid(s), in which $R^1$ to $R^3$, independently of one another, denote —H, —$CH_3$, a straight-chain or branched saturated alkyl functional group having 2 to 12 carbon atoms, a straight-chain or branched, monounsaturated or polyunsaturated alkenyl residue having 2 to 12 carbon atoms, alkyl functional groups or alkenyl residues substituted with —$NH_2$, —OH or —COOH as defined above, or —COOH or —$COOR_4$, wherein $R^4$ is a saturated or unsaturated, straight-chain or branched hydrocarbon functional group having 1 to 12 carbon atoms. Particularly preferred unsaturated carboxylic acids are acrylic acid, methacrylic acid, ethacrylic acid, α-chloroacrylic acid, α-cyanoacrylic acid, crotonic acid, α-phenylaciylic acid, maleic acid, maleic anhydride, fumaric acid, itaconic acid, citraconic acid, methylene malonic acid, sorbic acid, cinnamic acid or the mixtures thereof. It is also possible, of course, to use the unsaturated dicarboxylic acids. Among the sulfonic acid group-containing monomers, those of formula.

$$R^5(R^6)C{=}C(R^7)—X—SO_3H$$

are preferred, in which $R^5$ to $R^7$, independently of one another, denote —H, —$CH_3$, a straight-chain or branched saturated alkyl functional group having 2 to 12 carbon atoms, a straight-chain or branched, monounsaturated or polyunsaturated alkenyl residue having 2 to 12 carbon atoms, alkyl functional groups or alkenyl residues substituted with —$NH_2$, OH or —COOH, or —COOH or $COOR^4$, wherein $R^4$ is a saturated or unsaturated, straight-chain or branched hydrocarbon functional group having 1 to 12 carbon atoms, and X denotes an optionally present spacer group which is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Preferred among these monomers are those of formulas $$H_2C{=}CH—X—SO_3H$$

$$H_2C{=}C(CH_3)—X—SO_3H$$

$$HO_3S—X—(R^6)C{=}C(R^7)—X—SO_3H,$$

in which and $R^7$, independently of one another, are selected from —H, —$CH_3$, —$CH_2CH_3$, —$CH_2CH_2CH_3$ and —$CH(CH_3)_2$, and X denotes an optionally present spacer group, which is selected from —$(CH_2)_n$— where n=0 to 4, —COO—$(CH_2)_k$— where k=1 to 6. —C(O)—NH—$C(CH_3)_2$—, —C(O)—NH—$C(CH_3)_2$—$CH_2$— and —C(O)—NH—$CH(CH_3)$—$CH_2$—. Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacryl amido-2-methyl-1-propanesulfonic acid, 3-methacrylamido-2-hydroxypropanesulfonic acid, allylsulfonic acid, methallylsulfonic acid, allyloxybenzesulfonic acid, methallyloxybenzenesulfonic acid, 2-hydroxy-3-(2-propenyloxy) propanesulfonic acid, 2-methyl-2-propenesulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the described acids or the water-soluble salts thereof. The sulfonic acid groups can be present entirely or partially in neutralized form in the polymer, which is to say that, in some or all sulfonic acid groups, the acid hydrogen atom of the sulfonic acid group can be replaced with metal ions, preferably alkali metal ions, and in particular with sodium ions. The use of partially or fully neutralized sulfonic acid group-containing copolymers is preferred according to the invention. The monomer distribution of the preferably used copolymers is preferably 5 to 95 wt. % for copolymers that comprise only carboxylic acid group-containing monomers and sulfonic acid group-containing monomers, and particularly preferably the content of the sulfonic acid group-containing monomer is 50 to 90 wt. % and the content of the carboxylic acid group-containing monomer is 10 to 50 wt. %, the monomers preferably being selected from those described above. The molar mass of the preferably used sulfo copolymers can be varied so as to adapt the properties of the polymers to the desired intended purpose. Preferred detergents are characterized in that the copolymers have molar masses of 2000 to 200,000 $g/mol^{-1}$, preferably of 4000 to 25,000 $g/mol^{-1}$, and in particular of 5000 to 15000 $g/mol^{-1}$.

The detergents can comprise further polymers. The group of suitable polymers includes in particular polymers with cleaning action, for example rinse polymers and/or polymers acting as softeners. Polymers that are preferably used come from the group of alkylacrylamide/acrylic acid copolymers, alkylacrylamide/methacrylic acid copolymers, alkylacrylamide/methylmethacrylic acid copolymers, alkylacrylamide/acrylic acid/alkylaminoalkyl(meth)acrylic acid copolymers, alkylacrylamide/methacrylic acid/alkylaminoalkyl (meth)acrylic acid copolymers, alkylacrylamide/methylmethacrylic acid/alkylaminoalkyl(meth)acrylic acid copolymers, alkylacrylamide/alkyl methacrylate/alkyl aminoethyl methacrylate/alkyl methacrylate copolymers, and copolymers of unsaturated carboxylic acids, cationically derivatized unsaturated carboxylic acids, and optionally further ionic or non-ionogenic monomers. Further polymers that may be used come from the group of acrylamidoalkyltrialkylammonium chloride/acrylic acid copolymers and the alkali and ammonium salts thereof, acrylamidoalkyltrialkylammonium chloride/methacrylic acid copolymers and the alkali and ammonium salts thereof, and methacroylethylbetaine/methacrylate copolymers. Cationic polymers that may be used come from the groups of quaternized cellulose derivatives, polysiloxanes comprising quaternary groups, cationic guar derivatives, polymeric dimethyldiallylammonium salts and the copolymers thereof with acrylic acid and methacrylic acid and the esters and amides of acrylic acid and methacrylic acid, copolymers of vinylpyrrolidone with quaternized derivatives of dialkyaminoacrylate and -methacrylate vinylpyrrolidone/methoimidazolinium chloride copolymers, quaternized polyvinyl alcohols, or the polymers described by the INCI names Polyquaternium 2, Polyquaternium 17, Polyquaternium 18, and Polyquaternium 27.

The detergents preferably contain at least one enzyme preparation or enzyme composition, which contains one or more enzymes. Suitable enzymes include, but are not limited to, proteases, amylases, lipases, hemicellulases, cellulases, perhydrolases or oxidoreductases, and preferably the mixtures thereof. These enzymes are, in principle, of natural origin; proceeding from the natural molecules, improved variants are available for use in detergents and are used in correspondingly preferred fashion. The detergents preferably comprise enzymes in total amounts of $1\times10^{-6}$ to 5 wt %, based on active protein. The protein concentration can be determined using known methods, such as the BCA method or the biuret method.

Proteases are some of the technically most significant enzymes. They cause protein-containing soiling on the goods to be cleaned to decompose. Among these, in turn, proteases of the subtilisin type (subtilases, subtilopeptidases, EC 3.4.21.62) are particularly important, which due to the catalytically active amino acids are serine proteases. They act as non-specific endopeptidases and hydrolyze arbitrary acid amide bonds that lie in the interior of peptides or proteins. The pH optimum of these is usually in the distinctly alkaline range. Subtilases are formed naturally from microorganisms. Among these, in particular the subtilisins formed and secreted by the *Bacillus* species shall be mentioned as the most significant group within the subtilases. Examples of the proteases of the subtilisin type preferably used in detergents are the subtilisins BPN' and Carlsberg, the protease PB92, the subtilisins 147 and 309, the protease from *Bacillus lentus*, and in particular from *Bacillus lentus* DSM 5483, subtilisin DY, and the thermitase enzymes, which can be assigned to the subtilases, but not to the subtilisins in the narrower sense, proteinase K, and the proteases TW3 and TW7, and variants of the described proteases which have a modified amino acid sequence compared to the starting protease. Proteases are modified deliberately or randomly using methods known from the prior art and thus optimized for the use in detergents. These include point mutagenesis, deletion or insertion mutagenesis or fusion with other proteins or protein fragments. Appropriately optimized variants are known for the majority of proteases known from the prior art.

Examples of amylases that may be used include the α-amylases from *Bacillus licheniformis*, from *B. amyloliquefaciens* and from *B. stearothermophilus*, from *Aspergillus niger* and *A. oryzae*, and the refinements of the aforementioned amylases improved for the use in detergents. For this purpose, furthermore the α-amylase from *Bacillus* sp. A 7-7 (DSM 12368) and the cyclodextrin glucanotransferase (CGTase) from *B. agaradherens* (DSM 9948) shall be emphasized.

Furthermore, lipases or cutinases may be used, in particular for the triglyceride-liberating activities thereof, but also so as to create peroxy acids in situ from suitable precursors. These include, for example, the lipases which were originally obtainable or further developed from *Humicola lanuginosa* (*Thermomyces lanuginosus*), in particular those including the D96L amino acid substitution.

Furthermore, enzymes that are combined under the term hemicellulases may be used. These include, for example, mannanases, xanthan lyases, pectin lyases (=pectinases), pectin esterases, pectate lyases, xyloglucanases (=xylanases), pullulanases and β-glucanases.

To enhance the bleaching action, oxidoreductases, for example oxidases, oxygenases, catalases, peroxidases, such as haloperoxidases, chloroperoxidases, bromoperoxidases, lignin peroxidases, glucose peroxidases or manganese peroxidases, dioxygenases or laccases (phenol oxidases, polyphenol oxidases) may be used. Advantageously, preferably organic, and particularly preferably aromatic, compounds that interact with the enzymes are additionally added so as to enhance the activity of the particular oxidoreductases (enhancers), or so as to ensure the electron flux in the event of large differences in the redox potentials of the oxidizing enzymes and the soils (mediators).

In particular during storage, an enzyme can be protected against damage, such as inactivation, denaturing or disintegration, for example due to physical influences, oxidation or proteolytic cleavage. Inhibiting proteolysis is particularly preferred in the case of microbial production of the proteins and/or enzymes, in particular when the detergents comprise proteases. Detergents may comprise stabilizers for this purpose.

Proteases and amylases with cleaning action are generally not provided in form of the pure protein, but rather in the form of stabilized, storable and transportable preparations. These preformulated preparations include, for example, solid preparations obtained by way of granulation, extrusion or lyophilization or, in particular in the case of liquid or gel-like detergents, solutions of the enzymes, advantageously concentrated to the extent possible, low-hydrate and/or mixed with stabilizers or other auxiliary agents. Alternatively, the enzymes can be encapsulated, both for the solid and the liquid packaging format, for example by spray drying or extruding the enzyme solution together with a preferably natural polymer, or in the form of capsules, for example those in which the enzymes are enclosed as in a solidified gel, or in those of the core-shell type, in which an enzyme-containing core is coated with a protective layer impervious to water, air and/or chemicals. Further active ingredients, such as stabilizers, emulsifiers, pigments, bleaching agents or dyes can additionally be applied in superimposed layers. Such capsules are applied using methods that are known per se, for example agitation or roll granulation or in fluid bed processes. Such granules are advantageously low-dust, for example by applying polymeric film formers, and storage-stable due to the coating. It is furthermore possible to formulate two or more enzymes together, so that individual granules have multiple enzyme activities.

As is apparent from the comments above, the enzyme protein forms only a fraction of the total weight of customary enzyme preparations. Preferably used protease and amylase preparations contain between 0.1 and 40 wt. %, preferably between 0.2 and 30 wt. %, particularly preferably between 0.4 and 20 wt. %, and in particular between 0.8 and 10 wt. % of the enzyme protein. In particular, detergents that comprise 0.1 to 12 wt. %, preferably 0.2 to 10 wt. %, and in particular 0.5 to 8 wt. % enzyme preparations are preferred.

The compositions described herein can also comprise enzyme stabilizers. One group of stabilizers is that of reversible protease inhibitors. Frequently, benzamidine hydrochloride, borax, boric acids, boronic acids or the salts or esters thereof are used for this purpose, including especially derivatives with aromatic groups, such as ortho-, meta- or para-substituted phenylboronic acids, in particular 4-formylphenylboronic acid, or the salts or esters of the compounds mentioned. Peptide aldehydes, which is to say oligopeptides having a reduced C terminus, and in particular those formed from 2 to 50 monomers, are used for this purpose. The peptidic reversible protease inhibitors include ovomucoid and leupeptin. Specific reversible peptide inhibitors for the protease subtilisin and fusion proteins formed from proteases and specific peptide inhibitors are also suitable for this purpose.

Further enzyme stabilizers are amino alcohols such as mono-, di-, triethanol- and propanolamine and the mixtures thereof, aliphatic carboxylic acids up to $C_{12}$, such as succinic acid, other dicarboxylic acids or salts of the acids mentioned. End-capped fatty acid amide alkoxylates are also suitable for this purpose. Other enzyme stabilizers are known to a person skilled in the art from the prior art.

Peroxygen-based bleaching agents may also be present in the detergents. Among the compounds that serve as bleaching agents and yield $H_2O_2$ in water, sodium percarbonate, sodium perborate tetrahydrate, and sodium perborate monohydrate are of particular importance. Further usable bleaching agents are, for example, peroxypyrophosphates, citrate perhydrates, and peracid salts or peracids that yield $H_2O_2$, such as perbenzoates, peroxophthalates, diperazelaic acid, phthaloimino peracid, or diperdodecanedioic acid. All further inorganic or organic peroxy bleaching agents known from the prior art to a person skilled in the art may also be used. Percarbonates, and in particular sodium percarbonate, are particularly preferred bleaching agents.

In various embodiments, the detergents may comprise 1 to 35 wt. %, preferably 2.5 to 30 wt. %, particularly preferably 3.5 to 20 wt. %, and in particular 5 to 15 wt % bleaching agent, preferably sodium percarbonate.

In various embodiments of the invention, the detergents may additionally comprise at least one bleach activator. Compounds that, under perhydrolysis conditions, yield aliphatic peroxocarboxylic acids having preferably 1 to 10 carbon atoms, in particular 2 to 4 carbon atoms, and/or optionally substituted perbenzoic acid, can be used as bleach activators. Out of all bleach activators known to a person skilled in the art from the prior art, polyacylated alkylenediamines, in particular tetra acetyl ethylene diamine (TAED), acylated triazine derivatives, in particular 1,5-diacetyl-2,4-dioxohexahydro-1,3.5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl or iso-nonanoyl oxybenzene sulfonate (n- or iso-NOBS), are particularly preferred. It is also possible to use combinations of conventional bleach activators. TAED, in particular in combination with a percarbonate bleaching agent, preferably sodium percarbonate, is an especially particularly preferred bleach activator.

These bleach activators are preferably used in amounts of up to 10 wt. %, in particular 0.1 wt. % to 8 wt. %, particularly 2 to 8 wt. %, and particularly preferably 2 to 6 wt. %.

In general, the pH value of the detergent can be set using customary pH regulators, wherein the pH value is selected depending on the desired usage purpose. In various embodiments, the pH value is in a range of from 5.5 to 10.5, preferably from 5.5 to 9,5, still more preferably from 7 to 9, in particular greater than 7, and especially in the range of from 7.5 to 8.5, if the detergent is an automatic dishwasher detergent. If the detergent is a laundry detergent, the pH value may be higher and for example be in the range of from 8 to 12. Acids and/or alkalis, preferably alkalis, may be used for pH adjustment. Usable acids are in particular organic acids, such as acetic acid, citric acid, glycolic acid, lactic acid, succinic acid, adipic acid, malic acid, tartaric acid, and gluconic acid, or amidosulfonic acid. In addition, however, it is also possible to use the mineral acids hydrochloric acid, sulfuric acid and nitric acid, or the mixtures thereof. Suitable bases come from the group of the alkali metal and alkaline earth metal hydroxides and carbonates, in particular the alkali metal hydroxides, among which potassium hydroxide and especially sodium hydroxide is preferred. Volatile alkali, however, is particularly preferred, for example in the form of ammonia and/or alkanolamines, which can contain up to 9 carbon atoms in the molecule. The alkanolamine is preferably selected from the group consisting of mono-, di-, triethanol- and -propanolamine and the mixtures thereof.

So as to set and/or stabilize the pH value, the detergent according to the invention can also comprise one or more buffer substances (INCI Buffering Agents), usually in amounts of 0.001 wt. % to 5 wt. %. Buffering agents that simultaneously are complexing agents or even chelating agents (chelators, INCI Chelating Agents) are preferred. Particularly preferred buffering agents are citric acid or the citrates, and in particular sodium and potassium citrates, such as trisodium citrate-2.$H_2O$ and tripotassium citrate.$H_2O$.

Glass corrosion inhibitors prevent the appearance of clouding, streaking, and scratching, but also iridescence of the glass surface of automatically cleaned glassware. Preferred glass corrosion inhibitors come from the group of magnesium and zinc salts and of the magnesium and zinc complexes. Within the scope of the present invention, the content of zinc salt, especially in dishwasher detergents, is especially between 0.1 wt. % and 5 wt. %, preferably between 0.2 wt. % and 4 wt. %, and in particular between 0.4 wt. % and 3 wt. %, or the content of zinc (calculated as $Zn^{2+}$) is between 0.01 and 1 wt. %, especially between 0.02 and 0.5 wt. %, and in particular between 0.04 and 0.2 wt. %.

Individual odorous substance compounds, such as synthetic products of the ester, ether, aldehyde, ketone, alcohol, and hydrocarbon types, can be used as perfume oils or fragrances. Preferably, however, mixtures of different odorants are used, which together produce an appealing odorous note. Such perfume oils can also contain natural odorous substance mixtures such as those accessible from plant sources, for example pine, citrus, jasmine, patchouli, rose, or ylang ylang oil.

Furthermore, preservatives can be present in detergents. Suitable preservatives are, for example, those from the groups of the alcohols, aldehydes, antimicrobial acids and/or the salts thereof, carboxylic acid esters, acid amides, phenols, phenol derivatives, diphenyls, diphenyl alkanes, urea derivatives, oxygen and nitrogen acetals and formals, benzamidines, isothiazoles and the derivatives thereof, such as isothiazolins and isothiazolinones, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butyl carbamate, iodine, iodophores, and peroxides. Preferred antimicrobial active ingredients are preferably selected from the group consisting of ethanol, n-propanol, i-propanol, 1,3-butanediol, phenoxyethanol, 1,2-propylene glycol, glycerol, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl) urea, N,N'-(10-decandiyidi-1-pyridinyl-4-ylidene)-bis-(1-octanamine)-dihydrochloride, N,N'-bis-(4-chlorophenyl)-3,12-diimino-2,4,11,13-tetraazatetradecane diimidamide, antimicrobial quaternary surface-active compounds, and guanidines. Particularly preferred preservatives, however, are selected from the group consisting of salicylic acid, quaternary surfactants, and in particular benzalkonium chloride and isothiazoles, and the derivatives thereof, such as isothiazolines and isothiazolinones.

The detergents can be in solid or liquid presentation forms or in a combination of solid and liquid presentation forms. Suitable solid presentation forms are, in particular, powders, granules, extrudates, compactates, and in particular tablets. The liquid presentation forms based on water and/or organic solvents can be present in thickened form, in the form of gels. The detergents can be formulated in the form of single-phase or multi-phase products. The individual phases of multiphase detergents can have identical or different states of aggregation. The detergent can also be present in the form of shaped bodies. So as to facilitate the breakdown of such prefabricated shaped bodies, it is possible to incorporate disintegration auxiliaries, known as tablet disintegrants, into these agents in order to shorten breakdown times. Tablet disintegrants or disintegration accelerators are understood to mean auxiliaries that ensure a rapid breakdown of tablets in water or other media, and the quick release of the active ingredients. Disintegration auxiliaries can preferably be used in amounts from 0.5 wt. % to 10 wt. %, preferably 3 wt. % to 7 wt. %, and in particular 4 wt. % to 6 wt. %.

The detergents may be preformulated as dosing units. These dosing units preferably comprise the quantity of substances with cleaning action necessary for one cleaning cycle. Preferred dosing units have a weight between 12 g and 30 g, preferably between 14 g and 26 g, and in particular between 16 g and 22 g. The volume of the aforementioned dosing units and the three-dimensional shape thereof are particularly preferably selected such that dosability of the preformulated units via the dosing chamber of a washing machine or dishwashing machine is ensured. The volume of the dosing unit is thus preferably between 10 ml and 35 ml, and especially between 12 ml and 30 mol. The prefabricated dosing units preferably comprise a water-soluble wrapping. The water-soluble wrapping may, for example, be formed of a water-soluble film material selected from the group consisting of polymers or polymer mixtures. The wrapping can be formed of one layer, or of two or more layers of the water-soluble film material. The water-soluble film material of the first layer and that of the further layers, if such are present, can be the same or different. Films that can be bonded and/or sealed, after they have been loaded with the detergent, to form packaging such as tubes or cushions, are particularly preferred. The water-soluble packaging can comprise one or more chambers. The detergent can be present in one or more chambers, if present, of the water-soluble wrapping. The amount of the detergent preferably corresponds to the full dose, or half the dose, that is required for one washing operation. It is preferable for the water-soluble wrapping to comprise polyvinyl alcohol or a polyvinyl alcohol copolymer. Water-soluble wrappings comprising polyvinyl alcohol, or a polyvinyl alcohol copolymer exhibit good stability and sufficiently high water solubility, in particular cold-water solubility. Suitable water-soluble films for producing the water-soluble wrapping are preferably based on a polyvinyl alcohol, or a polyvinyl alcohol copolymer, having a relative molar mass in the range from 10,000 $gmol^{-1}$ to 1,000,000 $gmol^{-1}$, preferably from 20,000 $gmol^{-1}$ to 500,000 $gmol^{-1}$, particularly preferably from 30,000 $gmol^{-1}$ to 100,000 $gmol^{-1}$, and in particular from 40,000 $gmol^{-1}$ to 80,000 $gmol^{-1}$. Polyvinyl alcohol is typically produced by the hydrolysis of polyvinyl acetate. The same applies to polyvinyl alcohol copolymers produced accordingly from polyvinyl acetate copolymers and subsequent hydrolysis. It is preferred if at least one layer of the water-soluble wrapping comprises a polyvinyl alcohol having a degree of hydrolysis of 70 mole % to 100 mole %, preferably 80 mole % to 90 mole %, particularly preferably 81 mole % to 89 mole %, and in particular 82 mole % to 88 mole %. Additionally, a polymer selected from the group consisting of (meth)acrylic acid-containing (co)polymers, polyacrylamides, oxazoline polymers, polystyrene sulfonates, polyurethanes, polyesters, polyethers, polylactic acid or mixtures of the above polymers can be added to a polyvinyl alcohol-containing film material that is suitable for producing the water-soluble wrapping. A preferred additional polymer is polylactic acids. In addition to vinyl alcohol, preferred polyvinyl alcohol copolymers comprise dicarboxylic acids as further monomers. Suitable dicarboxylic acids are itaconic acid, malonic acid, succinic acid and mixtures thereof, itaconic acid being preferred. Likewise, preferred polyvinyl alcohol copolymers include an ethylenically unsaturated carboxylic acid, the salt thereof, or the ester thereof, in addition to vinyl alcohol. In addition to vinyl alcohol, such polyvinyl alcohol copolymers particularly preferably comprise acrylic acid, methacrylic acid, acrylic acid esters, methacrylic acid esters or mixtures thereof. It may be preferred for the film material to contain further additives. For example, the film material may contain plasticizers such as dipropylene glycol, ethylene glycol, diethylene glycol, propylene glycol, glycerol, sorbitol, mannitol or mixtures thereof. Examples of further additives include release aids, fillers, cross-linking agents, surfactants, antioxidants, UV absorbers, anti-blocking agents, non-stick agents or mixtures thereof. Suitable water-soluble films for use in the water-soluble wrappings of the water-soluble packagings according to the invention are films sold by MonoSol LLC, for example, by the designation M8630, C8400 or M8900. Other suitable films include films by the designation Solublon® PT, Solublon® GA, Solublon® KC or Solublon® KL from Aicello Chemical Europe GmbH, or the VF-HP films from Kuraray.

EXAMPLES

Example 1: Synthesis of Methyl-2-N-Salicylidene-3-hydroxypropanoate (Ligand 1)

To a solution of D/L-Serine methyl ester hydrochloride (9.81 g, 63 mmol) in 200 ml ethanol 9.9 ml triethylamine were added during stirring followed by salicylaldehyde (7.65 g, 63 mmol). The mixture turned yellow and was stirred for another 5 hours at room temperature. Then the solvent was removed under reduced pressure to afford a yellow oil which was purified by column chromatography (silica gel, n-pentane/ethyl acetate). The desired product was obtained as a yellow oil (11.8 g, 52.9 mmol, 84%).

$^1$H NMR (400 Hz, $CDCl_3$): δ (ppm): 2.50 (bs, 1H, —OH), 3.80 (s, 3H, $CH_3$), 3.95 (m, 1H, CH), 4.07-4.20 (m, 2H, $CH_2$), 6.85-7.05 (m, 2H, H arom), 7.23-7.41 (m, 2H, Harom), 8.42 (s, 1H, CHPh), 12.71 (bs, 1H, —OH).

MS (ESI, positive ion): 223 $[M+H]^+$ (100%).

Example 2: Synthesis of Zn Complex of Ligand 1

Under an atmosphere of nitrogen 245 mg (1.1 mmol) ligand 1 was dissolved in 20 ml ethanol. Under stirring 158 mg (0.55 mmol) $ZnSO_4$ were added. The mixture was stirred for 1 hour at room temperature. Afterwards 100 ml water were added and the reaction mixture was extracted four times with dichloromethane. The combined organic phases were dried over $Na_2SO_4$, filtered and concentrated under reduced pressure to afford the desired complex (210 mg, 0.41 mmol, 75%) as a light yellow solid.

MS (ESI, negative ion): 171 $[M-3H^+]^-$ (100%).

Example 3: Detergency

Ovalbumin and lactose (1:3) were suspended in water and stirred for 30 min at room temperature. After that excess water was removed by freeze drying. The resulting yellowish powder was heated for 10·minn (sample A1) or for 20 min (sample A2) at 140° C. and was then allowed to cool to room temperature. A 3.5 mM aqueous solution of a zinc complex with ligand 1 of example 1 was prepared by dissolving a suitable amount of Zn(11)sulfate heptahydrate with 2 equivalents of ligand 1. The pH was adjusted to 4 by addition of 1M HCl. After that 1.5 mg/ml of soluble Maillard reaction sample A1 or A2 were added. The mixtures were heated to 60° C. and stirred for 24 hours. The progress of the protein degradation in the reaction mixture was followed by SDS page gel analysis. For A1, after a reaction time of 1 hour at 60° C. no oligomeric Maillard reaction products with a molecular weight greater than 45 kDa were detected anymore; after 24 hours no protein bands were present any more, indicating a full degradation of all protein material. For A2, after a reaction time of 0.5 hour at 60° C. no oligomeric Maillard reaction products with a molecular weight greater than 100 kDa were detected anymore; after 24 hours no protein bands were present any more, indicating a full degradation of all protein material.

What is claimed is:

1. A detergent composition suitable for removing cooked-, baked- and burnt-on proteinaceous soils from surfaces, comprising a complex of a metal of groups 2 to 15 of the periodic system of elements with a ligand of formula I, (I)

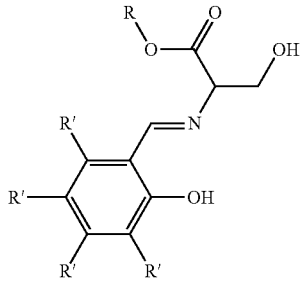

in which R stands for a linear or branched alkyl group, or a cycloalkyl, alkenyl, alkinyl, aryl or heteroaryl group with 1 to 20 C atoms, and each R', irrespective of each other, stands for —H, a linear or branched alkyl group, or —F, —Cl, —Br, —I, —$CF_3$, —OR", —$NO_2$, —$NH_2$, aryl, —CHO, —$Si(CH_3)_3$, —$SO_3^-M^+$, with M=Na, H or K, —$CO_2$R" or —C(=O)R" with R"=H or alkyl.

2. The detergent according to claim 1, wherein it comprises a complex with the ligand of formula I in amounts from 0.001% by weight to 20% by weight.

3. A method of removing cooked-, baked- and burnt-on proteinaceous soils from surfaces by contacting the soiled surface with an aqueous liquid comprising a complex of a metal of groups 2 to 15 of the periodic system of elements with a ligand of formula I, (I)

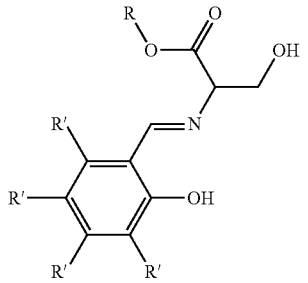

in which R stands for a linear or branched alkyl group, or a cycloalkyl, alkenyl, alkinyl, aryl or heteroaryl group with 1 to 20 C atoms, and each R', irrespective of each other, stands for —H, a linear or branched alkyl group, or —F, —Cl, —Br, —I, —$CF_3$, —OR", $NO_2$, —$NH_2$, aryl, —CHO, —$Si(CH_3)_3$, —$SO_3^-M^+$, with M=Na, H or K, —$CO_2$R" or —C(=O)R" with R"=H or alkyl.

4. The method according to claim 3, wherein the aqueous liquid comprises the complex in concentrations from 0.001 mmol/l to 10 mmol/l.

5. The method according to claim 3, wherein the contact of the aqueous liquid with the proteinaceous soil is for a time period in the range from 2 minutes to 24 hours.

6. The detergent composition according to claim 1, wherein in the ligands according to formula (I) R stands for an alkyl group with 1 to 10 C atoms, that all substituents R' are equal, and/or that at least one R' stands for H or —F, —Cl, —Br, —I, —$CF_3$, —OH, —$OCH_3$, —$OC_2H_5$, —$NO_2$, —$NH_2$, —$CO_2H$, —$CO_2$ $CH_3$, —$CO_2C_2H_5$, —C(=O)$CH_3$, —CHO, —$Si(CH_3)_3$, —$SO_3^-M^+$, with M is Na, H or K.

7. The detergent composition according to claim 1, wherein the metals in the complexes with the ligand according to formula (I) are selected from Mn, Zn, Cu, Co, V, and mixtures thereof.

8. The detergent composition according to claim 1, wherein —CHO, —$Si(CH_3)_3$, —$SO_3^-M^+$, with M=Na, H or K, —$CO_2R''$ or —C(=O)R'' with R''=H or $CH_3$ or $C_2H_5$.

9. The detergent according to claim 2, wherein it comprises a complex with the ligand of formula I in amounts from 0.01% by weight to 1% by weight.

10. The method, according to claim 3, of removing proteinaceous soils from hard surfaces or textile surfaces.

11. The method, according to claim 3, in which each R', irrespective of each other, stands for —H, a linear or branched alkyl group, or —F, —Cl, —Br, —I, —$CF_3$, —OR'', $NO_2$, —$NH_2$, aryl, —CHO, —$Si(CH_3)_3$, —$SO_3^-M^+$, with M=Na, H or K, —$CO_2R''$ or —C(=O)R'' with R''=H or $CH_3$ or $C_2H_5$.

12. The method according to claim 4, wherein the aqueous liquid comprises the complex in concentrations from 0.01 mmol/l to 5 mmol/l.

13. The method according to claim 4, wherein the contact of the aqueous liquid with the proteinaceous soil is for a time period in the range from 10 minutes to 12 hours.

14. The method according to claim 3, wherein in the ligands according to formula (I) R stands for an alkyl group with 1 to 10 C atoms, that all substituents R' are equal, and/or that at least one R' stands for H or —F, —Cl, —Br, —I, —$CF_3$, —OH, —$OCH_3$, —$OC_2H_5$, —$NO_2$, —$NH_2$, —$CO_2H$, —$CO_2CH_3$, —$CO_2C_2H_5$, —C(=O)$CH_3$, —CHO, —$Si(CH_3)_3$, —$SO_3^-M^+$, with M is Na, H or K.

15. The method according to claim 3, wherein the metals in the complexes with the ligand according to formula (I) are selected from Mn, Zn, Cu, Co, V, and mixtures thereof.

* * * * *